US011905788B2

(12) United States Patent
Poizat et al.

(10) Patent No.: US 11,905,788 B2
(45) Date of Patent: Feb. 20, 2024

(54) CEMENTING AND SAND CONTROL SYSTEM AND METHODOLOGY

(71) Applicant: Schlumberger Technology Corporation, Sugar Land, TX (US)

(72) Inventors: Jeremie Poizat, Houston, TX (US); Mark Anderson, Pearland, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 182 days.

(21) Appl. No.: 17/596,428

(22) PCT Filed: Jun. 10, 2020

(86) PCT No.: PCT/US2020/036996

§ 371 (c)(1),
(2) Date: Dec. 10, 2021

(87) PCT Pub. No.: WO2020/252021

PCT Pub. Date: Dec. 17, 2020

(65) Prior Publication Data

US 2022/0228446 A1 Jul. 21, 2022

Related U.S. Application Data

(60) Provisional application No. 62/861,201, filed on Jun. 13, 2019.

(51) Int. Cl.
*E21B 33/13* (2006.01)
*E21B 43/04* (2006.01)
(Continued)

(52) U.S. Cl.
CPC ..... *E21B 33/13* (2013.01); *E21B 17/046* (2013.01); *E21B 33/12* (2013.01); *E21B 33/14* (2013.01); *E21B 43/04* (2013.01); *E21B 43/045* (2013.01)

(58) Field of Classification Search
CPC ..... E21B 33/12; E21B 33/13; E21B 33/14; E21B 43/04; E21B 43/045; E21B 17/046
See application file for complete search history.

(56) References Cited

U.S. PATENT DOCUMENTS 4,105,069 A 8/1978 Baker
4,270,608 A 6/1981 Hendrickson et al.
(Continued)

FOREIGN PATENT DOCUMENTS

EP 0724065 A2 7/1996
EP 0724065 A3 3/1999
(Continued)

OTHER PUBLICATIONS

Baker Hughes, Baker Oil Tools, Product Report, Sand Control Systems, 2002, 1-page.
(Continued)

*Primary Examiner* — D. Andrews
(74) *Attorney, Agent, or Firm* — Jeffrey D. Frantz

(57) ABSTRACT

A technique facilitates downhole operations, e.g. gravel packing and cementing operations, in a borehole. According to an embodiment, a service tool is releasably coupled with respect to a casing. The casing is used to run the service tool downhole into a borehole. In some embodiments, the casing is connected with a downhole completion, e.g. a sand control completion. A work string may then be conveyed downhole to the service tool and connected to the service tool. While connected to the work string, the service tool may be operated to perform desired downhole operations.

16 Claims, 4 Drawing Sheets

(51) Int. Cl.

| | |
|---|---|
| ***E21B 17/046*** | (2006.01) |
| ***E21B 33/12*** | (2006.01) |
| ***E21B 33/14*** | (2006.01) |

(56) References Cited

U.S. PATENT DOCUMENTS

| | | | | |
|---|---|---|---|---|
| 4,722,392 | A | 2/1988 | Proctor et al. | |
| 4,858,690 | A | 8/1989 | Rebardi et al. | |
| 4,991,654 | A | 2/1991 | Brandell et al. | |
| 5,394,941 | A | 3/1995 | Venditto et al. | |
| 5,609,204 | A | 3/1997 | Rebardi et al. | |
| 5,921,318 | A | 7/1999 | Ross | |
| 6,202,742 | B1 | 3/2001 | Echols | |
| 6,216,785 | B1 | 4/2001 | Achee, Jr. et al. | |
| 6,446,727 | B1 | 9/2002 | Zemlak et al. | |
| 6,464,006 | B2 | 10/2002 | Womble | |
| 6,494,256 | B1 | 12/2002 | Achee, Jr. et al. | |
| 6,722,440 | B2 | 4/2004 | Turner et al. | |
| 6,776,239 | B2 | 8/2004 | Eslinger et al. | |
| 7,066,264 | B2 | 6/2006 | Bissonnette et al. | |
| 7,708,076 | B2 | 5/2010 | Richard et al. | |
| 9,085,960 | B2 | 7/2015 | van Petegem et al. | |
| 2002/0070027 | A1* | 6/2002 | Ohmer | E21B 34/06 166/69 |
| 2002/0117301 | A1 | 8/2002 | Womble | |
| 2005/0178552 | A1 | 8/2005 | Fehr et al. | |
| 2007/0068675 | A1 | 3/2007 | Barry et al. | |
| 2009/0188674 | A1 | 7/2009 | Guignard et al. | |
| 2012/0181024 | A1 | 7/2012 | Edwards | |
| 2013/0000899 | A1 | 1/2013 | Broussard et al. | |
| 2013/0277053 | A1 | 10/2013 | Yeh et al. | |
| 2016/0281468 | A1 | 9/2016 | Huh et al. | |

FOREIGN PATENT DOCUMENTS

| | | | |
|---|---|---|---|
| EP | 2800865 | B1 | 7/2018 |
| EP | 2800867 | B1 | 2/2019 |
| RU | 2317404 | C1 | 2/2008 |
| RU | 2374431 | C2 | 11/2009 |
| WO | 2006041825 | A2 | 4/2006 |
| WO | 2018165035 | A1 | 9/2018 |
| WO | 2018165043 | A1 | 9/2018 |

OTHER PUBLICATIONS

International Search Report and Written Opinion issued in PCT Application PCT/US2020/036996, dated Sep. 7, 2020 (13 pages).

* cited by examiner

Drop Ball, Set / Test Packer

RIH DP and Latch ST

RIH / Washdown / Displace OH

CEMENTING AND SAND CONTROL SYSTEM AND METHODOLOGY

CROSS-REFERENCE TO RELATED APPLICATION

This application is based on and claims priority to U.S. Provisional Application Ser. No. 62/861,201, filed Jun. 13, 2019, which is incorporated herein by reference in its entirety.

BACKGROUND

In many well applications, casing is deployed downhole into a wellbore and cemented in place within the wellbore. Additionally, a sand control completion system is deployed down through the casing and positioned in a cased or open wellbore section to facilitate production of desired fluids. For example, the wellbore may be drilled into a subterranean formation containing hydrocarbon fluids, e.g. oil, and the sand control completion facilitates production of hydrocarbon fluids. Sometimes a gravel pack is provided downhole to help filter particulates from the inflowing hydrocarbon fluids before they enter the sand control completion system.

SUMMARY

In general, a system and methodology are provided for facilitating downhole operations, e.g. gravel packing and cementing operations, in a borehole. According to an embodiment, a service tool is releasably coupled with respect to a casing. The casing is used to run the service tool downhole into a borehole. In some embodiments, the casing is connected with a downhole completion, e.g. a sand control completion. A work string may then be conveyed downhole to the service tool and connected to the service tool. While connected to the work string, the service tool may be operated to perform desired downhole operations.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

Figure 1:
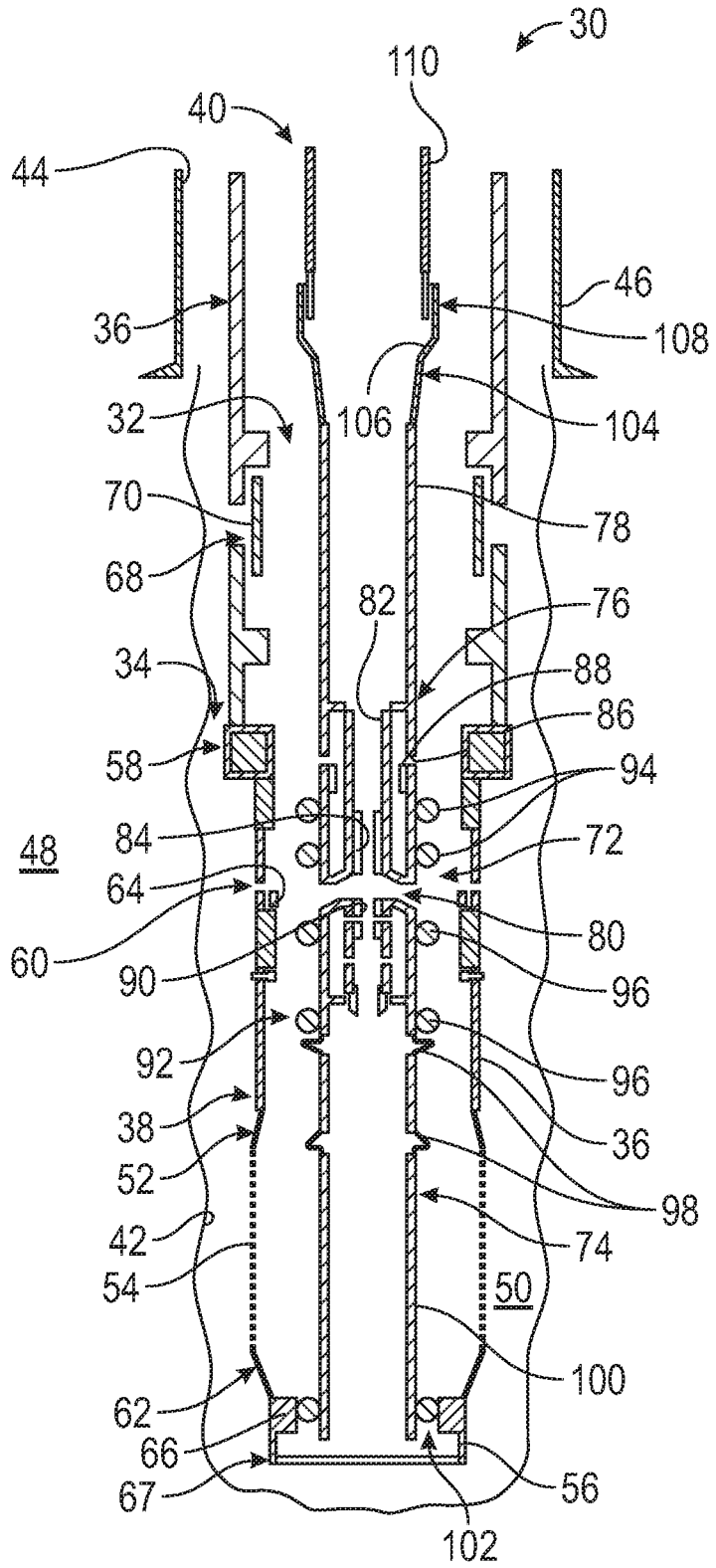
FIG. 1 is a schematic illustration of an example of a well system deployed downhole with a service tool located within a casing and coupled to a work string, according to an embodiment of the disclosure.

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The disclosure herein generally involves a methodology and system which facilitate downhole operations, e.g. cementing operations, gravel packing operations, sand control operations, and/or other downhole operations, in a borehole. By way of example, the methodology may comprise running a service tool with a casing. Subsequently, a work string may be connected to the service tool to enable operation of the service tool for various downhole operations, e.g. multizone downhole operations.

According to one embodiment, the casing is coupled with a downhole completion and the service tool is releasably coupled within the casing and/or downhole completion. The casing is used to run the service tool downhole into a borehole. In some embodiments, the downhole completion is in the form of a sand control completion, e.g. a multizone sand control completion. A work string may then be conveyed downhole to the service tool and connected to the service tool. While connected to the work string, the service tool may be operated to perform the desired downhole operations.

For example, a sand control completion may be coupled with the casing and the service tool may be releasably mounted inside. This overall assembly may be run downhole into a wellbore simultaneously. Subsequently the work string may be conveyed downhole and connected, e.g. latched, to the service tool to enable performance of various downhole operations. Examples of downhole operations include cementing operations and gravel packing operations. Once downhole operations are completed, the work string may be used to pull the service tool out of hole (e.g. out of the wellbore) to allow hydrocarbon production operations and/or other desired operations.

Depending on the application, the well system and methodology may be used to enable simultaneous cementing and placement of a sand control system. Such a sand control system may be utilized in various formation treatments, e.g. fracturing, proppant slurry injection, and/or gravel packing. The well system and methodology also facilitate treatment of one or multiple subterranean formations combined with cementing of a casing in a single trip. The casing may be in the form of various types of casings or liners and may be located above the treatment zone or zones. In these types of applications, the service tool may comprise a well treatment tool conveyed downhole via the casing and then coupled with the work string. The well treatment tool may be used in a variety of processes including circulating or squeeze type treatments and cleanup operations via reversing out excess slurry (e.g. cement or proppant) by reverse flow or by dumping the excess below.

Referring generally to FIG. 1, an example of a well system 30 is illustrated. In this embodiment, the well system 30 comprises a service tool 32 which may be run downhole into a borehole 34, e.g. a wellbore, via a casing 36. In some applications, the casing 36 may be connected with a downhole completion 38. Additionally, the service tool 32 may be selectively connected with a work string 40 after the service tool 32 is conveyed downhole via casing 36.

The borehole 34 may comprise a variety of wellbores or other boreholes and may include at least one open hole section 42 and at least one outer cased section 44 which is cased with an outer casing 46. The outer casing 46 may be suspended from a casing hanger located at, for example, the surface. The at least one open hole section 42 may be drilled into a surrounding formation 48 and may extend through one or more well zones 50. In some applications, the wellbore 34 may include deviated, e.g. horizontal, sections extending through the well zones 50. The surrounding formation 48 may contain a reservoir of hydrocarbon fluids, e.g. oil and/or natural gas.

Additionally, the downhole completion 38 may be constructed in various configurations and with different types of components. By way of example, the downhole completion 38 may comprise a sand control completion 52 having at least one sand screen 54, e.g. a plurality of sand screens 54, separated by blanks 56 (blank pipe sections). The sand screens 54 filter out particulates from, for example, inflowing well fluid. Prior to running the sand control completion 52 downhole, the downhole completion 38 may undergo a displacement procedure according to one or more embodiments of the present disclosure. However, the displacement procedure may also be omitted without departing from the scope of the present disclosure.

The downhole completion 38 may comprise a variety of other components, such as a packer 58, e.g. an open hole packer, a gravel pack sleeve assembly 60, and a No-Go 62. The gravel pack sleeve assembly 60 may comprise a shiftable gravel pack sleeve 64 which may be shifted within the service tool 32 between different gravel packing positions. In one or more embodiments of the present disclosure, the gravel pack sleeve 64 may be shrouded and centralized with a grease in the inner diameter (ID). The No-Go 62 may comprise a latch 66 or other retention feature for releasably coupling the service tool 32 with downhole completion 38 or other downhole system. The No-Go 62 or other suitable feature also may be connected to a washdown assembly 67. These components and systems are provided as examples and the downhole completion 38/sand control completion 52 may comprise various additional and/or other components and features.

Additionally, the downhole completion 38 may be deployed in various types of wellbores. For example, the downhole completion 38 may be in the form of sand control completion 52 with a plurality of sand screen assemblies having sand screens 54 positioned along wellbore 34, e.g. along a horizontal section of wellbore 34. The sand screens 54 may be separated by a plurality of the packers 58 to create a plurality of corresponding isolated well zones 50 along the horizontal section of wellbore 34.

In the illustrated embodiment, the casing 36 also may comprise or may be combined with various features. By way of example, the casing 36 and/or downhole completion 38 may include or may be coupled with a cement sleeve assembly 68. The cement sleeve assembly 68 may have a sleeve 70 which is shiftable by the service tool 32 between different cementing positions. In one or more embodiments of the present disclosure, the cement sleeve 70 may be shrouded and centralized with a grease in the ID. Depending on parameters of a given downhole operation, the casing 36 and/or downhole completion 38 may comprise various additional components or other types of components arranged in configurations to facilitate the given downhole operation.

Referring again to FIG. 1, the service tool 32 also may have a variety of components and configurations. By way of example, the service tool 32 may comprise a circulation assembly 72 combined with a wash pipe assembly 74. According to an embodiment, the circulation assembly 72 may comprise tubing 76 having a spacer string 78. Crossover ports 80 may be positioned along the tubing 76, e.g. in a port body, to enable fluid communication between an interior passage 82 and an exterior of the circulation assembly 72. The crossover ports 80 may be selectively opened and closed via shifting of a sleeve 84.

In the illustrated example, the circulation assembly 72 also comprises return ports 86 which cooperate with an annular check valve 88. The circulation assembly 72 also may include a wash down ball seat 90 positioned to receive a ball for blocking flow along the interior passage 82. Various seals 92 may be positioned along the exterior of tubing 76 to enable selective sealing with portions of the surrounding structures, e.g. portions of the surrounding downhole completion 38 and/or casing 36. By way of example, the seals 92 may comprise upper seals 94, e.g. swab cups, and lower seals 96, e.g. swab cups. Depending on the application, various types of shifters 98 may be positioned along the exterior of the circulation assembly 72 and/or wash pipe assembly 74 to enable shifting of external components, e.g. sleeves 64, 70, during movement of service tool 32.

The wash pipe assembly 74 also may comprise many types of features depending on the parameters of a given environment and/or application. By way of example, the wash pipe assembly 74 may comprise a space out joint 100 and a seal assembly 102 positioned to selectively form a seal with a surrounding component of, for example, downhole completion 38. Wash pipe assembly 74 also may comprise a variety of other components or features, such as shifters 98, wash pipe joints and diverter valves.

In the illustrated example, the service tool 32 also comprises a latch profile 104 which may be coupled to tubing 76 of circulation assembly 72. In some embodiments, the latch profile 104 may be combined with a polished bore receptacle 106. The latch profile 104 is configured for coupling/engagement with a corresponding anchor latch 108 of work string 40.

It should be noted that work string 40 also may comprise a variety of components and features selected according to the parameters of a given operation and environment. In various applications, the work string 40 comprises drill pipe 110 or other suitable pipe connected to anchor latch 108 for engagement with service tool 32 after service tool 32 is conveyed downhole via casing 36.

Figure 2:
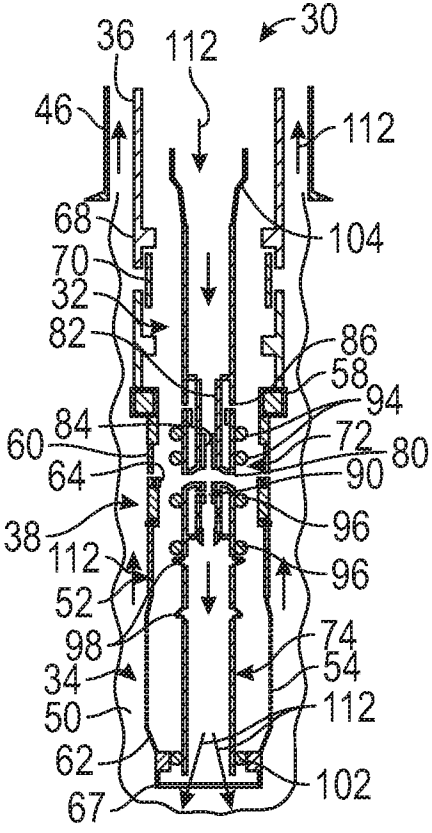
FIG. 2 is a schematic illustration of the well system in which the service tool is conveyed downhole into a borehole, e.g. a wellbore, via the casing, according to an embodiment of the disclosure.

Referring generally to FIGS. 2-10, an operational example is provided. In this embodiment, the service tool 32 is releasably coupled within casing 36, e.g. at least partially within casing 36, as illustrated in FIG. 2. As illustrated, the service tool 32 may be positioned inside both casing 36 and completion 38 while being releasably coupled with at least one of the casing 36 and completion 38. By way of example, the service tool 32 may be releasably coupled within casing 36 via latch 66 of downhole completion 38.

Figure 3:
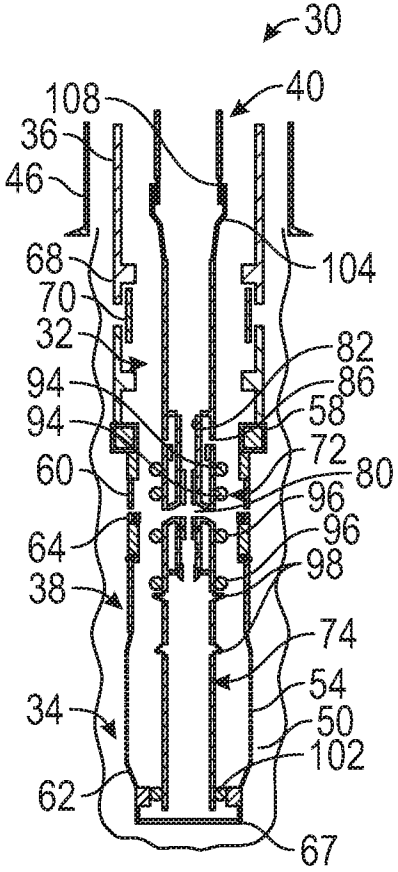
FIG. 3 is a schematic illustration similar to FIG. 2 but showing the well system in a different operational position, according to an embodiment of the disclosure.

In this configuration (see FIG. 2), the service tool 32 is run in hole via casing 36. Once positioned at a desired location within borehole/wellbore 34, washdown fluid may be pumped down through the service tool 32 and up through the annulus surrounding completion 38 to displace fluid in the open hole annulus, as represented by arrows 112. While the service tool 32 is positioned at the desired location in borehole 34, the work string 40 may be run in hole and connected to the service tool 32, as illustrated in FIG. 3.

By way of example, the work string 40 may be connected to service tool 32 by engaging anchor latch 108 with latch profile 104. As discussed above, the work string 40 may comprise drill pipe 110 or other suitable tubing along with appropriate components or features for a given operation. It should be noted the washdown represented by arrows 112 could be performed after connection of the work string 40 with service tool 32.

Figure 4:
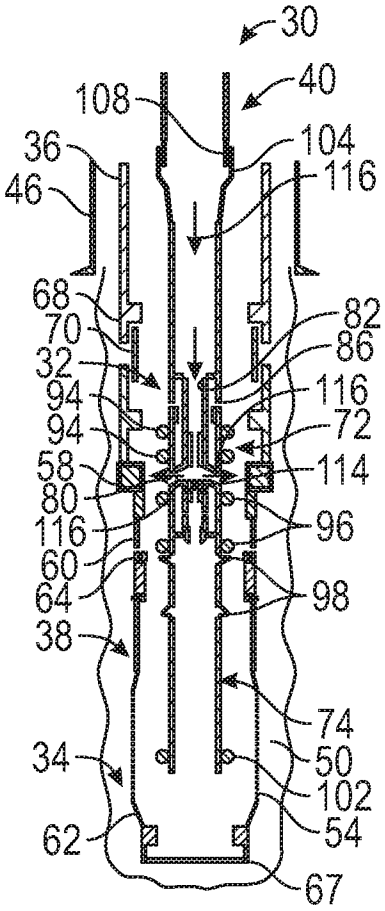
FIG. 4 is a schematic illustration similar to FIG. 3 but showing the well system in a different operational position, according to an embodiment of the disclosure.

Once the work string 40 is connected to service tool 32, the service tool 32 may be operated to perform desired downhole operations, e.g. gravel packing operations, cementing operations, and/or other desired downhole operations. By way of example, the service tool 32 may be used for certain operations by dropping a ball 114 down through the interior of work string 40 and through interior passage 82 until seating against ball seat 90 as illustrated in FIG. 4. For this operation, the service tool 32 is lifted via work string 40 to the position illustrated in FIG. 4 such that top seals 94 are sealed against interior features of casing 36 and bottom seals 96 are sealed against features of downhole completion 38 so as to isolate the crossover ports 80.

When positioned against ball seat 90, the ball 114 blocks flow of fluid down through the interior of service tool 32 beneath ball 114. Accordingly, after the ball 114 is seated, actuation fluid may be directed down through work string 40 and through interior passage 82 until being forced outwardly through crossover ports 80 as indicated by arrows 116. Because seals 94, 96 are sealed against their surrounding features, the actuation fluid can be pressurized to set packer 58, thus isolating the region/annulus around downhole completion 38.

Figure 5:
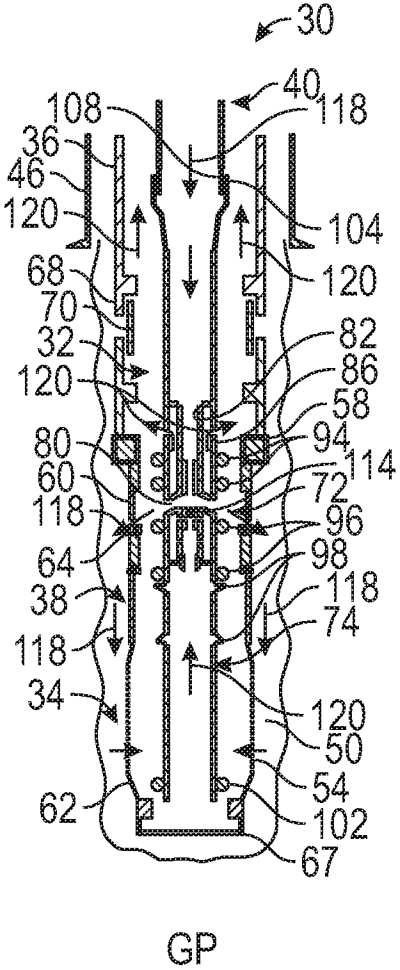
FIG. 5 is a schematic illustration similar to FIG. 4 but showing the well system in a different operational position, according to an embodiment of the disclosure.

In some embodiments, a gravel packing operation may then be performed, as illustrated in FIG. 5. For example, the service tool 32 may be moved downhole via work string 40 to the position illustrated in FIG. 5 such that seals 94, 96 seal against the interior of completion 38 above and below gravel pack sleeve assembly 60. This allows a gravel slurry (represented by arrows 118) to be directed down through the interior of work string 40 and along interior passage 82 until being forced out through crossover ports 80 and gravel pack sleeve assembly 60 into the annulus surrounding downhole completion 38. Return fluids (represented by arrows 120) can flow up through wash pipe assembly 74 and through appropriate porting of service tool 32 until exiting through return ports 86 into the annulus between service tool 32/work string 40 and the surrounding casing 36. The return fluids may flow uphole along this annulus until reaching the surface.

Figure 6:
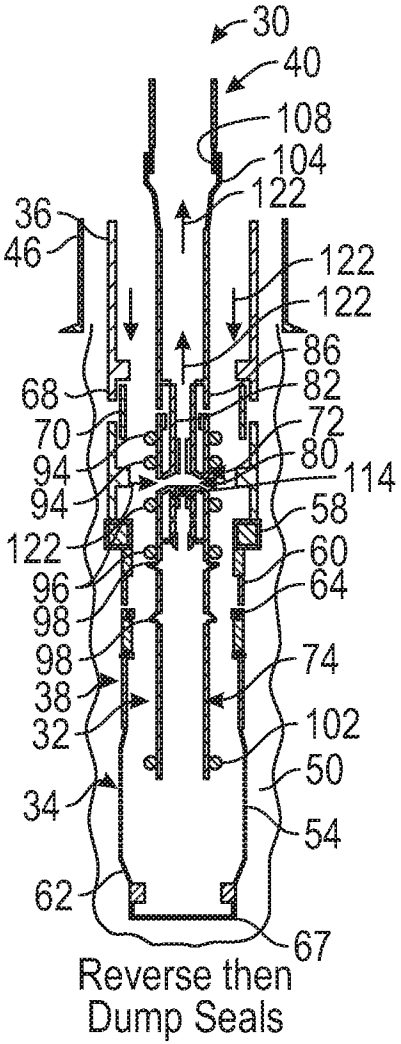
FIG. 6 is a schematic illustration similar to FIG. 5 but showing the well system in a different operational position, according to an embodiment of the disclosure

Following the gravel packing operation, the seals 94, 96 may be dumped (i.e. moved to a non-sealing position) by lifting the service tool 32 via work string 40 as illustrated in FIG. 6. In this position a reverse flow of fluid may be directed along the exterior of service tool 32, in through crossover ports 80, and up through interior passage 82 and further up through the interior of work string 40 as illustrated by arrows 122 in FIG. 6.

Figure 8:
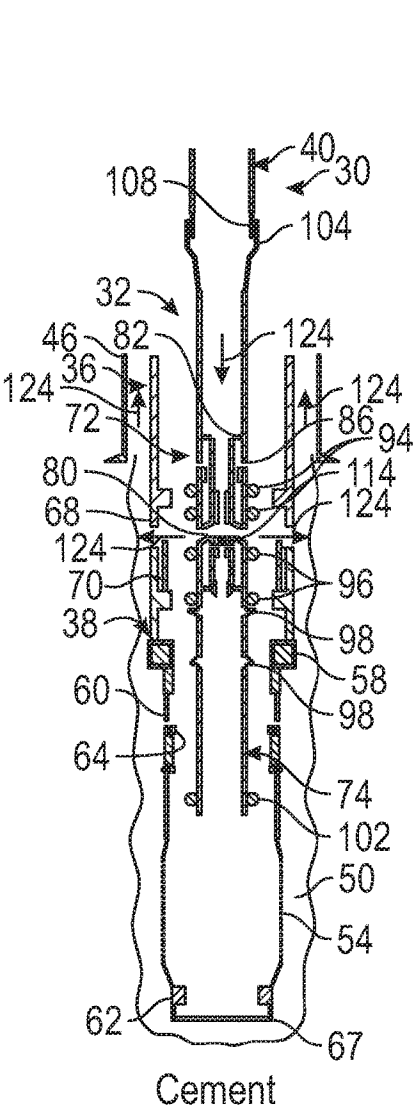
FIG. 8 is a schematic illustration similar to FIG. 7 but showing the well system in a different operational position, according to an embodiment of the disclosure.
Figure 7:
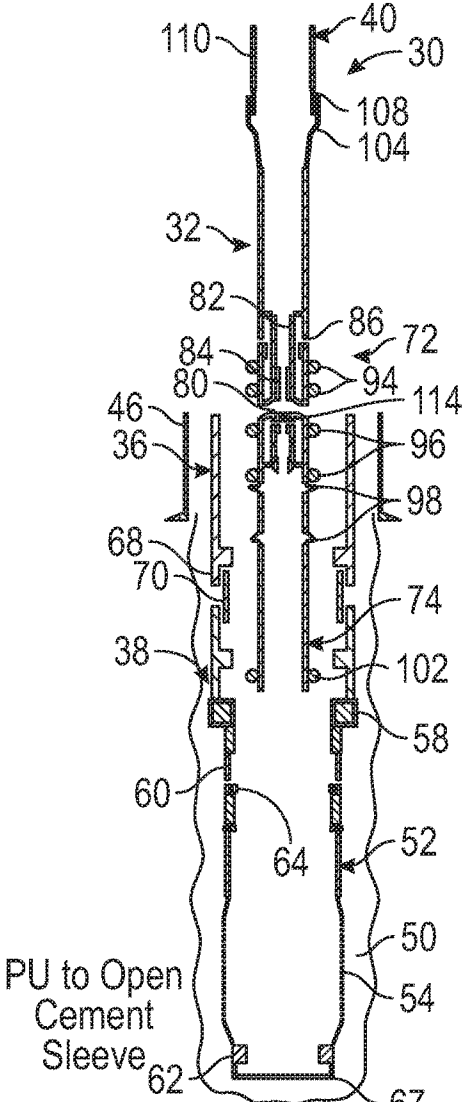
FIG. 7 is a schematic illustration similar to FIG. 6 but showing the well system in a different operational position, according to an embodiment of the disclosure.

After reversing out the remaining slurry, the service tool 32 may be lifted in the up hole direction via work string 40 to a position as illustrated in FIG. 7 so as to enable opening of cement sleeve 70. Once the service tool 32 is positioned as illustrated in FIG. 7, the work string 40 may again be used to move service tool 32 downwardly so the appropriate shifter 98 may shift cementing sleeve 70 to an open position, as illustrated in FIG. 8. In the position shown in FIG. 8, the seals 94, 96 are once again sealed against their surrounding structures so as to isolate crossover ports 80.

This allows a cementing material to be directed down through the interior of work string 40 and along interior passage 82 until being forced out through crossover ports 80 and cement sleeve assembly 68 into the annulus surrounding casing 36 as indicated by arrows 124. The cement material flows upwardly into the annulus between casing 36 and the outer casing 46.

Figure 10:
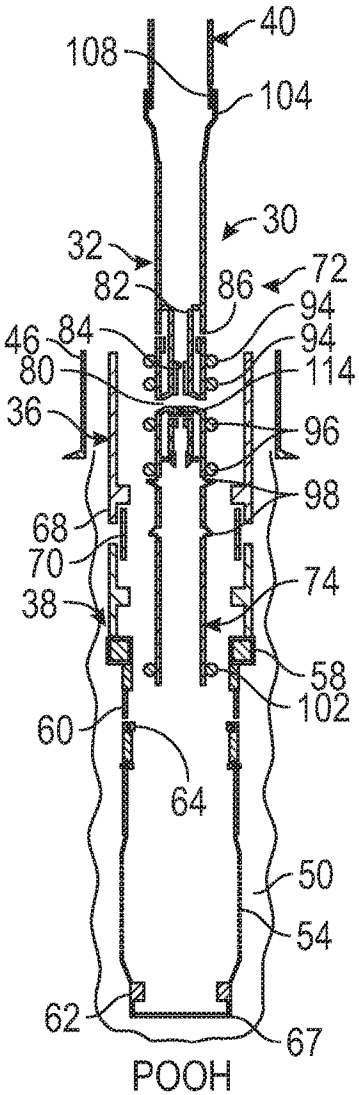
FIG. 10 is a schematic illustration similar to FIG. 9 but showing the well system in a different operational position, according to an embodiment of the disclosure.
Figure 9:
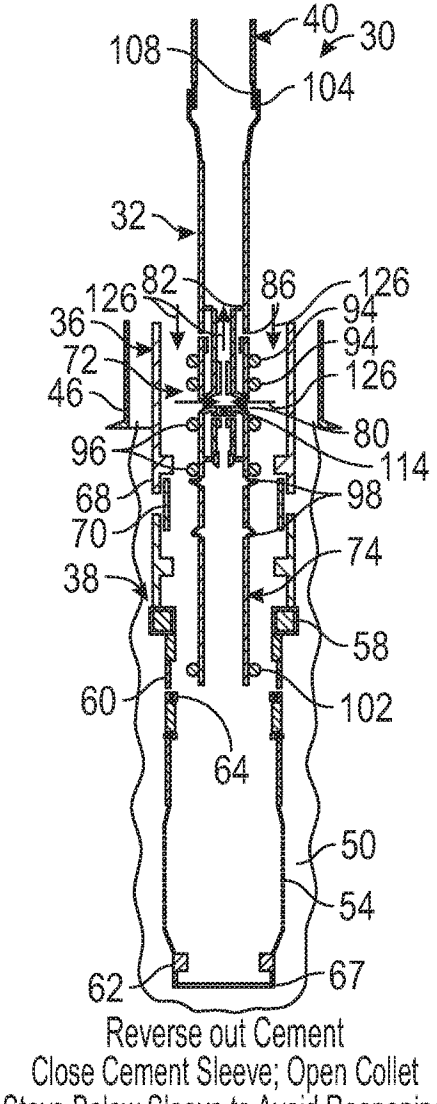
FIG. 9 is a schematic illustration similar to FIG. 8 but showing the well system in a different operational position, according to an embodiment of the disclosure.

Once sufficient cement is deposited, the service tool 32 may be lifted via work string 40 to the position illustrated in FIG. 9 in which the lower seals 96 remain sealed against the surrounding structure of casing 36. This allows the remaining cement in service tool 32 and the interior of work string 40 to be reversed out by directing fluid down through the annulus between casing 36 and service tool 32, in through crossover ports 80, and up through interior passage 82, as represented by arrows 126 in FIG. 9. After completing the cementing operation, the service tool 32 may be pulled out of hole via work string 40 as illustrated in FIG. 10.

The downhole operations illustrated in FIGS. 2-10 provide examples of how the service tool 32 may be run in hole on casing 36 and then operated to perform various downhole operations. However, the overall well system 30 may be used in various configurations to perform a variety of downhole operations.

As described herein, the sand control completion 52 may be combined with the cementing assembly, e.g. cement sleeve assembly 68, and run downhole with service tool 32 via casing 36. Depending on the parameters of a given application, the assembly may be run in hole in mud or brine. Subsequently, the work string 40 may be run in hole and connected to the service tool 32 for displacement of fluid in the open hole section 42.

The packer or packers 58 may then be set and a gravel pack operation may be performed in the open hole section 42 followed by the appropriate reverse out procedure. (In some applications, the sand control completion 52 may be a stand-alone completion and the gravel packing operation may be omitted.) After gravel packing, the cementing operation may be performed as described above and then the service tool 32 may be pulled out of hole. However, the deployment of service tool 32 and operation of service tool 32 may have variations to accommodate parameters of desired downhole operations.

According to another example, the methodology may be employed for completing a well with multiple zones in a single trip and with a single pumping treatment. In this embodiment, the sand control completion 52 may be combined with the cementing assembly, e.g. cement sleeve assembly 68, and run downhole with service tool 32 via casing 36. Subsequently, the work string 40 may be run in hole and connected to the service tool 32 for displacement of fluid in the open hole section 42.

A plurality of packers 58 may then be set to establish well zones 50 which may be treated in one treatment using shunted sand screens 54 and shunted open hole packers 58. Following the well treatment, the cementing operation may be performed as described above and then the service tool 32 may be pulled out of hole.

According to another example, the methodology may be employed for completing a well with multiple zones (located in the open hole section) in a single trip and with multiple pumping treatments. In this embodiment, the sand control completion 52 may be combined with the cementing assembly, e.g. cement sleeve assembly 68, and run downhole with service tool 32 via casing 36. Subsequently, the work string 40 may be run in hole and connected to the service tool 32 for displacement of fluid in the open hole section 42.

A plurality of packers 58 may then be set to establish well zones 50. The individual well zones 50 may each be treated according to a suitable sequence which may include: placing the service tool 32 across a screen assembly to open a screen sleeve; placing the service tool across a gravel pack assembly to open the corresponding gravel pack sleeve 64 and to position the service tool 32 for performance of the desired treatment in that zone 50; treating the given zone 50; reversing out and closing the gravel pack sleeve 64; dumping the seals 94, 96; and closing the screen valve. Following the well treatments of zones 50, the cementing operation may be performed as described above and then the service tool 32 may be pulled out of hole.

According to another example, the methodology may be employed for completing a well with multiple zones (located in cased and open hole sections) in a single trip and with multiple pumping treatments. In this embodiment, the sand control completion 52 may be combined with the cementing assembly, e.g. cement sleeve assembly 68, and run downhole with service tool 32 via casing 36. Subsequently, the work string 40 may be run in hole and connected to the service tool 32 for displacement of fluid in the open hole section 42.

A plurality of packers 58 may then be set to establish well zones 50 along cased and open hole sections of the wellbore 34. The individual well zones 50 may each be treated according to a suitable sequence which may include: placing the service tool 32 across a screen assembly to open a screen sleeve; placing the service tool across a gravel pack assembly to open the corresponding gravel pack sleeve 64 and to position the service tool 32 for performance of the desired treatment in that zone 50; treating the given zone 50; reversing out and closing the gravel pack sleeve 64; dumping the seals 94, 96; and closing the screen valve. Following the well treatment of zones 50, an initial cementing operation may be performed independently through a cement sleeve while taking returns through a casing/liner return sleeve and then closing the given casing/liner cementing sleeve following this particular cementing operation.

The service tool 32 may then be placed adjacent a given cementing section treatment sleeve so as to open the sleeve to a treat position. A treatment operation, e.g. a fracturing operation, may then be performed through the treatment sleeve. Subsequently, the treatment sleeve is closed and the service tool 32 is moved to the next cementing zone for repeating of the cementing operation in that zone. The service tool 32 may then be pulled out of hole. Additionally, a suitable shifting tool may be run in hole to move each treatment sleeve to a production position for production of the desired hydrocarbon fluids.

It should be noted, however, the service tool 32 may be deployed via casing 36 for performance of various downhole operations in single zones or plural zones along the borehole 34. Additionally, the various systems and components of well system 30 may be adjusted according to the parameters of the downhole environment and/or operations.

For example, the completion string comprising completion 38 may include various types of washdown assemblies 67 and screens 54, e.g. screens with or without mud protection. Additionally, the completion 38 may comprise various types of gravel pack sleeve assemblies 60 with at least one port and with at least one corresponding sleeve 64 as well as position locators. The completion 38 also may comprise an individual packer 58 or a plurality of the packers 58. In some embodiments, the completion 38 may include the cement sleeve assembly 68 which may comprise at least one cement port with corresponding sleeves 70 as well as position locators.

Similarly, the service tool 32 may include various types and configurations of components. For example, the service tool 32 may include various types of shifters 98 configured and oriented for interaction with corresponding sleeves and locators. Additionally, various configurations of crossover ports 80, crossover port bodies, and seals 94, 96 may be employed to achieve a desired sealing and fluid flow path.

For example, the crossover ports 80 and seals 94, 96 may be arranged to provide a path for circulating fluid down the work string 40 while taking returns through the screens 54 and back through appropriate porting in the service tool 32 to the annulus between the work string 40 and the casing 36. The crossover ports 80 and seals 94, 96 also may be arranged to provide a path to circulate fluid down through work string 40 and then up through the surrounding annulus or vice versa. In some embodiments, a path for circulating fluid may be routed down through the work string 40 to the bottom of the wash pipe assembly 74 and up through the annulus surrounding the completion 38 to the surface. The service tool components also may be arranged to provide a path for circulating fluid down through the work string 40 to the bottom of the wash pipe assembly 74 after conveying the gravel pack.

In some embodiments, the crossover ports, seals 94, 96, and other service tool components may be arranged to eliminate swabbing by keeping constant hydrostatic communication with the formation during movements of service tool 32. Accordingly, the components and the arrangement of components of service tool 32 may be adjusted according to the desired fluid circulation and operation of the service tool 32 for given downhole applications.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A method for use in a well, comprising:

releasably coupling a service tool within a casing;

running the service tool via the casing downhole into a wellbore;

positioning a sand control completion coupled to the casing at a downhole location for gravel packing;

conveying a work string downhole to the service tool after positioning the sand control completion at the downhole location;

connecting the work string to the service tool via a latch at a lower end of the work string; and using the service tool while connected to the work string to perform downhole operations the downhole operations including:

pumping a gravel slurry through the work string, the latch, and the service tool; and pumping cement through the work string, the latch, and the service tool.

2. The method as recited in claim 1, further comprising pulling the service tool out of the wellbore with the work string after using the service tool to perform the downhole operations.

3. The method as recited in claim 1, wherein the running step comprises running the service tool downhole with the casing and the sand control completion.

4. The method as recited in claim 3 further comprising providing the sand control completion with sand screen assemblies and a packer.

5. The method as recited in claim 4, further comprising delivering fluid down through the work string and the service tool to set the packer.

6. The method as recited in claim 1, further comprising forming the work string with drill pipe.

7. A method, comprising:

coupling a sand control completion with casing;

conveying a service tool downhole into a borehole with the sand control completion via the casing;

positioning the sand control completion at a downhole location for gravel packing;

subsequently connecting the service tool with a work string via a latch at a lower end of the work string; and using the service tool downhole to perform downhole operations, the downhole operations including:

opening a gravel pack sleeve assembly of the sand control completion using a shifter of the service tool; and pumping a gravel slurry through the work string, the latch, the service tool, and the gravel pack sleeve assembly.

8. The method as recited in claim 7, further comprising releasing the service tool and pulling the service tool out of hole via the work string while the casing and the sand control completion remain downhole.

9. The method as recited in claim 7, wherein the subsequently connecting step comprises latching a drill pipe to the service tool.

10. The method as recited in claim 7, wherein coupling the sand control completion with the casing comprises coupling a sand screen completion with the casing.

11. The method as recited in claim 7, wherein the downhole operations include setting a packer of the sand control completion.

12. The method as recited in claim 7, wherein the downhole operations include using the service tool to perform a cementing operation.

13. The method as recited in claim 7, further comprising providing the service tool with a circulation assembly and a wash pipe assembly.

14. A system, comprising:

a service tool positioned downhole via casing, the service tool having:

a latch profile;

a circulation assembly below the latch profile; and one or more shifters below the circulation assembly, the one or more shifters configured to open a gravel pack sleeve; and a work string having a latch which is latchable into the latch profile after the service tool is positioned downhole.

15. The system as recited in claim 14, further comprising a sand control completion connected to the casing.

16. The system as recited in claim 14, wherein the circulation assembly is actuatable to perform a gravel packing operation and a cementing operation.

* * * * *